US005262817A

United States Patent [19]

Krystal

[11] Patent Number: 5,262,817

[45] Date of Patent: Nov. 16, 1993

[54] SWITCHING SYSTEM FOR A FILM PROCESSOR APPARATUS

[75] Inventor: Leonard Krystal, Kane County, Ill.

[73] Assignee: Fischer Industries, Inc., Geneva, Ill.

[21] Appl. No.: 771,205

[22] Filed: Oct. 4, 1991

[51] Int. Cl.[5] ..... G03D 3/08

[52] U.S. Cl. ..... 354/319

[58] Field of Search ..... 354/303, 307, 319, 320, 354/323, 324

[56] References Cited

U.S. PATENT DOCUMENTS

| | | | |
|---|---|---|---|
| 4,057,817 | 11/1977 | Korb et al. | 354/298 |
| 4,324,479 | 4/1982 | Sachs | 354/319 |
| 4,497,558 | 12/1985 | Cooperberg et al. | 354/319 X |
| 4,515,456 | 5/1985 | Ferrante | 354/320 |
| 4,941,008 | 7/1990 | Nakamura | 354/320 |

*Primary Examiner*—D. Rutledge

*Attorney, Agent, or Firm*—Polster, Lieder, Woodruff & Lucchesi

[57] ABSTRACT

A switching system consists of a pressure sensitive floor pad containing internal, sealed electrical contacts, and solid-state electronic timer and associated circuitry. The floor pad is positioned so that an operator must step on the pad in order to feed film into a film processor apparatus. When an operator steps on the pad, an electric circuit is completed, which causes the film processor apparatus to automatically switch from a "stand-by" mode to a "run" mode, without requiring an operator to remember to activate any switch and without any need for film-sensing devices. After the operator steps back off the floor pad (after having fed one or more films into the apparatus), the electronic timing circuit continues the operation of the processing cycle for a time period sufficient to insure that any film inserted is fully processed. Because the timer does not start timing until after the last film has been introduced into the processor, no film can remain in the processor when the processor is returned to its stand-by mode. When the timer times out, the electronic circuitry automatically returns the apparatus to the "stand-by" mode.

11 Claims, 2 Drawing Sheets

SWITCHING SYSTEM FOR A FILM PROCESSOR APPARATUS

BACKGROUND OF THE INVENTION

This invention relates, generally, to film processor apparatus and, more particularly, to an improved automatic switching system for such devices. This invention is related to the inventions disclosed in copending applications U.S. Ser. No. 07/635,281 filed Dec. 28, 1990, entitled Heat Exchanger, U.S. Ser. No., 07/641,459 filed Jan. 14, 1991, entitled Roller Tank, U.S. Ser. No. 771,737, entitled Improved Solution Filling System For A Film Developer Apparatus, filed Oct. 4, 1991, and U.S. Ser. No. 771,203, entitled Top-Drop Film Feed System, filed Oct. 4, 1991. All of these applications are assigned to the assignee of the present application. The disclosure of these copending and commonly assigned applications are intended to be incorporated by reference herein.

As is known in the art, typical film processors operate in three modes: "off"; "run"; and; "stand-by". In the "off" mode, all operating systems of the processor are off. In the "run" mode, all operating systems of the processor are on. In the "stand-by" mode, all operating systems of the processor are off except, generally those systems associated with maintaining the temperature of the developer solution. Some processors, in addition to maintaining the temperature of the developer solution, also enter into a "jog" cycle during the "stand-by" mode, in which the transport rollers or transport belts go into operation for a short pre-selected time, in order to minimize crystallization of evaporating developer and/or fixer on the rollers or web belts which carry the film through the processor.

In order to process film in a film processor, the processor must be in the "run" mode and the developer solution must be elevated to a pre-selected temperature. Typical film processors are manually switched from the "off" mode to the "run" mode at the start of each day. After the developer solution reaches its pre-selected temperature, the processor is ready and able to automatically process (i.e. develop, fix, wash and dry) film.

When the apparatus is in the "run" mode, with all systems operating, the apparatus consumes electricity and generates substantial heat (from its dryer system). This heat causes evaporation, and degeneration, of the developer and fixer solutions. Additionally, in the "run" mode the gearing, rollers, motor and pumps are gradually worn down through general wear and tear. Accordingly, typical film processors have a "stand-by" mode. As indicated, in the "stand-by" mode, most operating systems are in the "off" mode, to minimize evaporation and wear and tear. Only the developer solution heating system remains in operation, to maintain the developer at the proper temperature for immediate use.

Typical film processors employ manual, semi-automatic and automatic means to switch the processors between their "stand-by" and "run" modes. In manual systems, the operator manually presses a switch, causing the processor to switch from "stand-by" to "run" and thereafter, the operator inserts films for automatic processing. After completion of processing, the operator must then manually press a switch to return the apparatus to "stand-by". In semi-automatic systems, the operator manually presses a switch to cause the apparatus to switch from "stand-by" to "run" and thereafter may insert films for processing. Then, after a pre-selected time (sufficient for the operator to insert and process a standard quantity of films), the apparatus automatically returns to "stand-by". In automatic systems, the act of inserting films triggers an infra-red switch or delicate manual sensors, for example, which automatically cause the processor to switch from "stand-by" to "run" for a fixed period of time sufficient to allow full processing of the inserted film. After processing, the automatic processor automatically returns to "stand-by".

However, in typical film processor apparatus employing automatic switching systems, the switching systems are somewhat expensive and often difficult to service, and are prone to operational problems due to the corrosive nature of fumes from the developer solutions, which attack the infra-red sensors, the delicate manual sensors, and associated printed circuit boards. In typical film processors employing manual or semi-automatic switching systems, operators frequently forget to press switches when required, resulting in films being left within processors which entered "stand-by" prior to completion of a full processing cycle, or resulting in processors being left in the "run" mode all day long, producing excessive wear and tear and excessive evaporation of solutions.

Thus, an improved switching system for film processor apparatus is desired.

One object of this invention is to provide an improved automatic film processor for developing film.

Another object is to provide a switching system which does not require an operator to remove or activate switches.

Another object is to provide such a processor wherein the switch is not subject to corrosion from film developing chemicals.

Other objects of this invention will be apparent to those skilled in the art in light of the following description and accompanying drawings.

SUMMARY OF THE INVENTION

According to the invention generally stated, there is provided a method for operating an automatic film processor. The film processor includes a foot pad containing a switch, a timing circuit on a control board connected to the switch, and circuitry which controls the film processing operations. The method includes stepping on the pad to close the switch, to switch the processor from a stand-by mode to a run mode and to then manually introduce film into the processor and to then step off the pad to start the timing circuit's timer to begin counting down. The timer does not start timing the process until after the operator steps off the pad. After the timer has been started, more films may be introduced at any time by again stepping on the pad. Stepping on the pad after the timer has initally been started will reset the timer. The timer will thus start timing for its full pre-set time when the operator again steps off the pad.

DESCRIPTION OF THE PREFERRED EMBODIMENT

Figure 1:
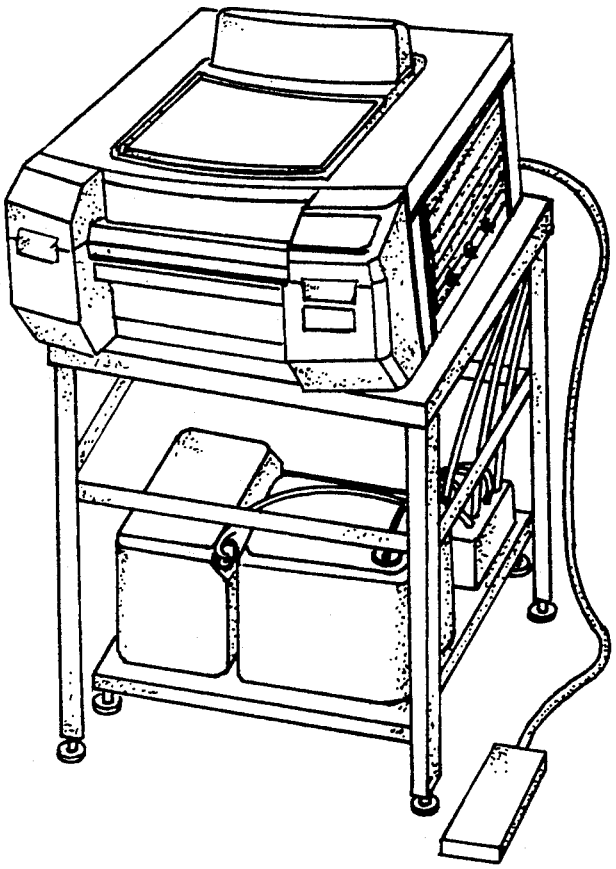
FIG. 1 is a perspective view of the location of the pressure sensitive floor pad in relation to the film processor apparatus.
Figure 2:
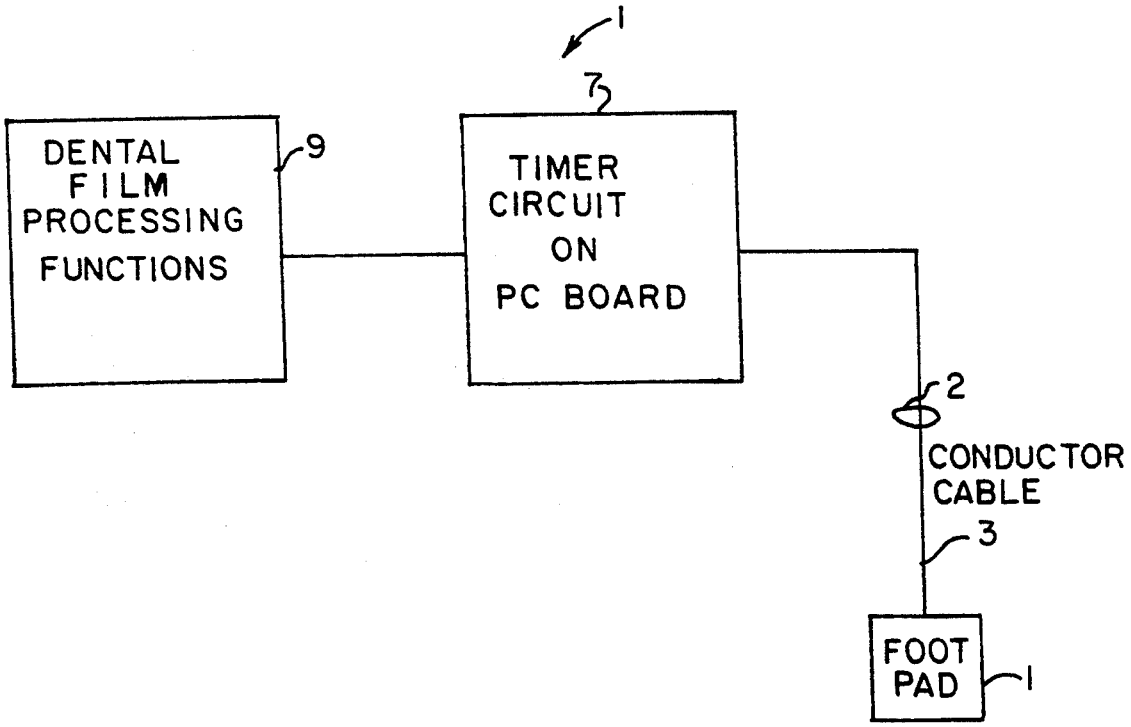
FIG. 2 is a block diagram of the electrical circuit.
Figure 3:
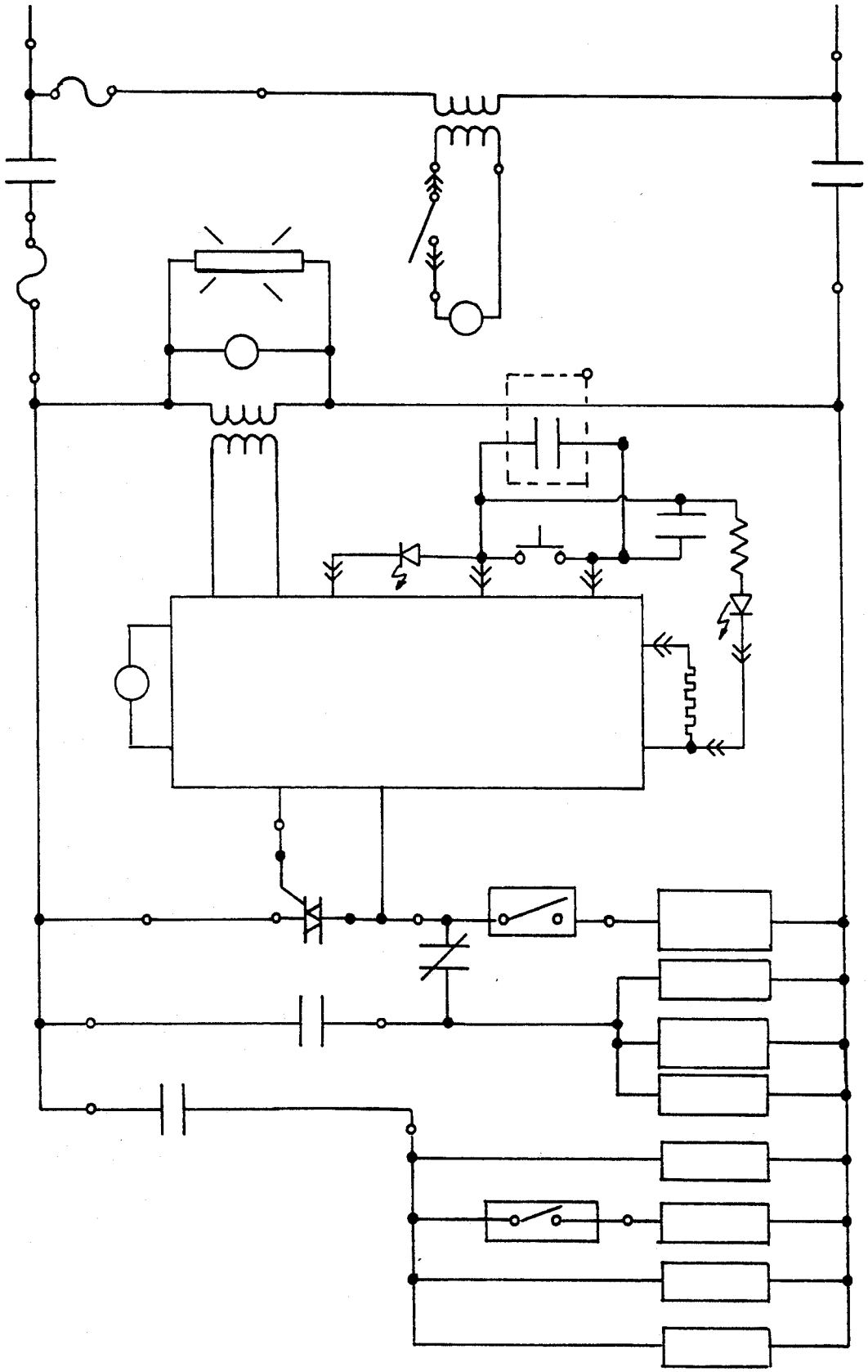
FIG. 3 is a circuit diagram showing the electrical system relating to the invention.

The improved switching system of the invention overcomes the shortcomings of the prior art and consists of a processor P and a sealed, pressure sensitive, electric contact pad 1 located on the floor immediately near the film processor P. The exact location of the pad 1 may vary. However, it is positioned so that the operator necessarily steps on the pad 1 while inserting film along a film drop area 60. The pressure sensitive floor pad 1 contains a pressure sensitive switch 3 which is connected electrically by a two-conductor wire 5 to a timer circuit 7 on a controller board C. A timer 8 is connected to timing circuit 7. Timer 8 may be pre-set for a desired time or may be programmable. Timer circuit 7 is connected to circuitry 9 through the controller board. Circuitry 9 operates film processing functions as is known.

When pad 1 is stepped-on, the pressure sensitive switch 3 completes a circuit, which signals the controller to switch processor P from its "stand-by" mode to its "run" mode. Closing the contact also signals the controller to activate a film feeder, which is part of circuitry 9, into which an operator places film to insert film into the processor. The location of the floor pad is such that the operator must physically step on the pad in order to be able to insert films into the film processor apparatus.

The activated solid-state timing device 7 causes the apparatus to remain in the "run" mode until such time as the operator steps off the pressure sensitive floor pad 1 (i.e. after the operator has inserted into the apparatus all films to be processed). When the operator steps off floor pad 1, the switch 3 is opened, signalling timer 8 to begin "counting down" from the pre-selected time setting. During this time, the controller operates circuit 9 to develop the film. The time setting is selected to be sufficient to allow for full processing of any film inserted immediately prior to the time that the operator steps off the pressure sensitive floor pad. Upon expiration of the time period, timer 8 sends a signal to circuitry 7 to signal controller C to switch circuitry 9 of processor P from "run" to "stand-by". Because pad 1 is the only operator controlled switch, processor P cannot be returned to its stand-by mode until timer 8 times out.

The timing circuitry 7 and timer 8 determine how long the processor P is to be in its run mode. New batches of film may be introduced at any time. After the timer has been activated, the operator may step upto the processor to begin processing a new batch of films. By stepping on pad 1, switch 3 is closed and timer 8 is reset When the operator steps off the pad, the timer is again started for the time period. The machine will now not be turned off until the timer times out. Resetting the timer and not starting the timer until after the operator takes his foot off pad 1 ensures that the last film introduced into processor 1 will be fully processed, i.e. the processor will not be returned to its stand-by mode while film is still in the processor.

By the above system, the operator is never required to "remember" to activate any switch, and the apparatus is always ready to immediately process films whenever the operator steps up to the film feeding area. Equally important, no film can be caught in the apparatus due to any automatic switching to "stand-by" mode prior to completion of a full film processing cycle, and no film can be inadvertently inserted into the apparatus while the apparatus is in "stand-by". Moreover, the apparatus is always in the economical "stand-by" mode unless an operator specifically requires the "run" mode, by their physical presence in the specific film-feeding position required by the apparatus. Finally, the pressure sensitive floor pad is sealed, and is made of appropriate materials which are impervious to developer and/or fixer solution spills.

Numerous variations, within the scope of the appended claims, will be apparent to those skilled in the art in light of the foregoing description and accompanying drawings. For example, the timer could have two time durations.

Having thus described the invention, what is claimed and desired to be secured by Letters Patent is:

1. A method for operating an automatic film processor to develop film, the processor including a foot pad containing a switch, a timing circuit on a control board which is connected to the switch, and circuitry, in electrical communication with the timing circuit, which controls the film developing operations, the method comprising:

closing said switch to switch said processor from a stand-by mode to a run mode;

introducing film into said film processor;

opening said switch to activate a timer, said timer signalling said control board to switch said processor from said run mode back to said standby mode after a desired time has elapsed; and automatically resetting said timer whenever said switch is closed.

2. The method of claim 1 wherein said step of introducing film into said processor may be performed only when said processor is in its run mode.

3. The method of claim 1 wherein said switch is a pressure sensitive switch, said closing step comprising applying pressure to said switch and said opening step comprises removing pressure from said switch.

4. The method of claim 3 wherein said pressure sensitive switch is contained in a foot pad, said steps of applying pressure to and removing pressure from said switch comprising stepping on and stepping off said foot pad.

5. In an automatic film processor for developing film having stations for developing the film, means for moving said film through said stations, and timing circuitry for timing a film developing cycle; the improvement comprising a switch, which when closed signals said controller to switch said processor from a stand-by mode to a run mode and to activate a film acceptor, and which when thereafter closed signals said controller to start a timer, said timer being connected to said controller to cause said controller to return said processor to said stand-by mode from said run mode after a desired time has elapsed; and means for automatically resetting said timer whenever said switch is closed.

6. The improvement of claim 5 wherein said switch is contained in a pressure sensitive pad.

7. The improvement of claim 6 wherein said pad is a foot pad located on a floor at said processor.

8. A method for controlling an automatic film processor movable between a stand-by mode and a run mode, the processor having a timing circuit in electrical communication with a controller which controls film developing, and a switch in communication with said timer, the method comprising:

closing said switch to reset said timer and to place said processor in said run mode;

opening said switch to begin said timer, said timer signalling said processor to return to said stand-by mode when said timer times out; and automatically resetting said timer whenever said switch is closed.

9. An automatic film processor having a timing circuit which times a film developing cycle, a switch which starts said timer, means for placing film in said processor at any time and automatic means for ensuring that said processor will not shut off until the last film introduced into said processor is developed.

10. The automatic film processor of claim 9 wherein said means includes said switch, said switch being movable between an open position and a closed position, wherein when said switch is closed said timer is reset and when said switch is thereafter opened, said timer is started to run for its full time.

11. The improvement of claim 5 wherein said switch must be closed to introduce film into said film processor, said timer resetting means including said switch.

* * * * *